United States Patent [19]

Mantelet

[11] 4,056,111

[45] Nov. 1, 1977

[54] COSMETIC APPLICATOR

[76] Inventor: Jean Mantelet, 46-48, Avenue Montaigne, 75008 Paris, France

[21] Appl. No.: 692,185

[22] Filed: June 2, 1976

[30] Foreign Application Priority Data

Mar. 30, 1976 France ..... 76.09133

[51] Int. Cl.[2] ..... A45D 40/26; A45D 24/00

[52] U.S. Cl. ..... 132/88.7; 132/11 A

[58] Field of Search ..... 132/88.7, 11 A, 11 R, 132/85; 128/62; 15/248 R, 22; 185/37x; 46/206

[56] References Cited

U.S. PATENT DOCUMENTS

| | | | |
|---|---|---|---|
| 3,033,197 | 5/1962 | Barckley | 128/62 R |
| 3,349,782 | 10/1967 | Sawin | 132/11 A |
| 3,384,096 | 5/1968 | Paccione | 132/11 A |
| 3,870,186 | 3/1975 | Reinhard | 132/85 |

*Primary Examiner*—G.E. McNeill

*Attorney, Agent, or Firm*—Young & Thompson

[57] ABSTRACT

A cosmetic applicator, particularly for eyelashes, comprises a hand-held casing supporting a motor-driven rotatable output shaft having in axial extension thereof a rod carrying a cylindrical brush having radially extending bristles. The motor may be a clockwork motor or an electric battery powered motor and the output shaft may be rotated in either direction by axial displacement of a pinion forming part of a step-up mechanism fastened to the output shaft, said displacement being effected by a key mounted on the casing.

9 Claims, 4 Drawing Figures

10
12
14
16
18
20
22
24
26
28
30
32
34
36
38
40
42
II
III

COSMETIC APPLICATOR

BACKGROUND OF THE INVENTION

This invention relates to an applicator for cosmetic products, particularly for eyelash make-up.

It refers more particularly to applicators comprising a painting tool, such as a cylindrical or conical brush having radially extending bristles, which tool is carried by a rod, the axis of which is an extension of the axis of the tool and is adapted to receive the cosmetic product. The object of the application is to facilitate the use of applicators of this kind.

According to the invention there is provided an applicator for cosmetic products, particularly for eyelashes, comprising a painting tool, such as a cylindrical or conical brush having radially extending bristles, which tool is carried by a rod the axis of which is an extension of the axis of the tool and is adapted to receive the said product, wherein the rod is mounted for rotation in a casing adapted to be held by hand, and a drive device comprising a rotary output shaft is coupled to the rod.

Thus the painting tool is given a rotary movement during a make-up operation, thus enabling it to be used conveniently without requiring any particular manual skill.

DESCRIPTION OF THE PREFERRED EMBODIMENT

Figures 1, 2, 3, 4:
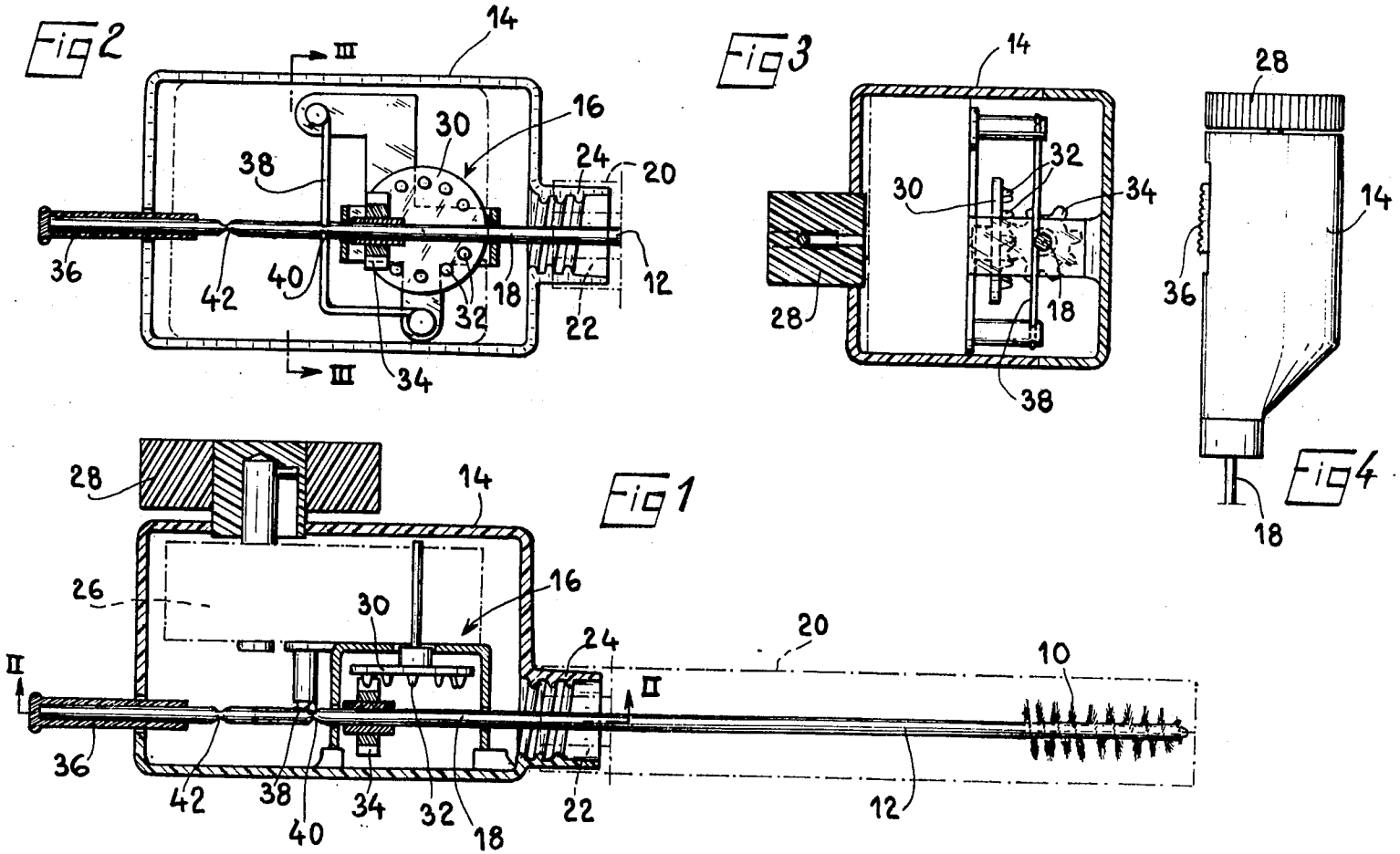
FIG. 1 is a longitudinal section of a cosmetic product applicator according to the invention.
FIG. 2 is a partial section thereof on the line II—II in FIG. 1.
FIG. 3 is a cross-section on the line III—III in FIG. 2.
FIG. 4 is a partial view in elevation of a second embodiment of the invention.

The cosmetic applicator shown in FIG. 1 comprises a painting tool of known kind, such as a conical brush 10 having helicoidally arranged radially extending bristles, this tool being carried by a rod 12, the axis of which is an extension of the axis of the tool, and adapted to receive the cosmetic product.

According to the invention, the applicator comprises, in a casing 14 adapted to be held by hand, a drive device given the general reference 16 and comprising a rotating output shaft 18 integral with or fastened to the rod 12 of the brush 10.

As shown in dashed lines in FIG. 1, the applicator is used with a removable refill 20 of cosmetic product. This refill, of a type widely available in commerce, is in the form of a tube adapted to fit over and around the brush 10 and rod 12. The open end 22 of the tube can be fixed, for example by a screw connection, in a collar 24 fastened to the casing 14 and surrounding the rotating output shaft 18.

The drive device 16 comprises a spiral spring motor 26 which can be rewound with the aid of a winder button 28 mounted for rotation on the casing about an axis perpendicular to the axis of the output shaft 18. A speed step-up mechanism is disposed between the motor 26 and the shaft 18 and so constructed that the speed of rotation of the said shaft 18 will be between three and ten revolutions per second.

The speed step-up mechanism is arranged to enable the shaft 18 to be rotated in either direction, as selected by the user. It may comprise, as illustrated, a driving wheel 30, that is to say a wheel, a flat face of which is provided with a circular series of frustoconical studs 32 adapted to mesh with a toothed pinion 34 fastened to the shaft 18. The assembly comprising the shaft 18 and pinion 34 can slide axially in the casing 14 through the manual operation of a key 36 which is carried by the opposite end of the shaft 18 to that where the rod 12 is disposed and which projects from the casing 14. The movable arrangement 18, 34, 36 thus formed can in particular occupy two operative positions, in which the pinion 34 meshes respectively with two diametrically opposite regions of the circular series of studs 32 on the wheel 30 and in which, it will be understood, the pinion 34 and consequently the shaft 18 turn in opposite directions. These two operative positions of the movable assembly are defined respectively by the resilient engagement of a filiform spring 38 in one or other of two grooves 40 and 42 spaced apart and formed in the shaft 18.

In order to utilise the applicator, the user starts by removing the cosmetic product refill 20 which, when the apparatus is not in use, must normally remain screwed on the casing 14 in order to prevent the brush 10 from drying out.

The refill 20 having been removed and the motor 26 having been suitably rewound, the brush 10 rotates in one direction or the other depending on the position of the key 36. The user holds the casing 14 in one hand and brings the brush 10 into contact with the lashes of one eye for the purpose of applying the cosmetic product. By operation of the key 36 she reverses the direction of rotation of the brush in order to make-up the lashes of the other eye. Thus the make-up operation is effected very conveniently, the movement of the brush necessary for smoothing the lashes upwards being achieved automatically, with the desired amplitude, without any movement of the user's fingers.

The invention is obviously not limited to the embodiment illustrated in FIGS. 1 to 3, but on the contrary various modifications may be made to this embodiment without departing from the scope of the appended claims.

Thus, as illustrated in FIG. 4, it may be preferred to give the casing 14 a generally cylindrical shape with its axis parallel to the output shaft 18, to place the winder button 28 opposite the shaft 18, to mount this button for rotation about an axis parallel to the shaft 18, and to mount the key 36 for axial sliding on the side wall of the casing 14. It will be understood that with an arrangement of this kind the step-up mechanism contained in the casing 14 will be arranged differently from that described in FIGS. 1 to 3.

It is also possible to envisage equipping the apparatus with a small electric motor fed by a battery, with a switch for reversing the direction of rotation under the control of the key 36.

I claim:

1. An applicator for a cosmetic product, particularly for eyelashes, comprising a painting tool, such as a cylindrical or conical brush having radially extending bristles, which tool is adapted to receive the said product and is carried by a rod, the axis of which is an extension of the axis of the tool, said rod being mounted for rotation in a casing adapted to be held by hand, and a drive device contained in said casing and comprising a rotary output shaft coupled to the rod, wherein the drive device comprises a spiral spring motor adapted to be wound by means of a button mounted for movement on and relative to the casing, and a speed step-up mechanism disposed between the motor and the output shaft.

2. An applicator according to claim 1, wherein the drive device comprises control means to reverse the direction of rotation of the output shaft.

3. An applicator according to claim 2, wherein the direction of rotation of the output shaft is reversible by axial displacement of a pinion forming part of the step-up mechanism and fastened to the output shaft, and wherein said displacement is controllable by a key mounted for movement on the casing and adapted to occupy two positions corresponding respectively one to each of the two directions of rotation of the output shaft.

4. An applicator according to claim 1, wherein a collar fastened to the casing and surrounding the rotary output shaft is adapted to receive a removable cosmetic product refill in the form of a tube which is adapted to fit over and around the painting tool and rod.

5. An applicator according to claim 1, wherein the speed of rotation of the output shaft is between three and ten revolutions per second.

6. An applicator according to claim 1, wherein the winder button is mounted for rotation on the casing about an axis perpendicular to the output shaft.

7. An applicator according to claim 1, wherein the casing has a generally cylindrical shape with its axis parallel to the axis of the output shaft and wherein the winder button is situtated on the casing oppositely to the output shaft and is mounted for rotation about an axis parallel to the axis of the shaft.

8. An applicator according to claim 3, wherein the winder button is mounted for rotation on the casing about an axis perpendicular to the output shaft.

9. An applicator according to claim 3, wherein the casing has a generally cylindrical shape with its axis parallel to the axis of the output shaft and wherein the button is situated on the casing oppositely to the output shaft and is mounted for rotation about an axis parallel to the axis of the shaft.

* * * * *